US012130070B2

(12) United States Patent
Zhao et al.

(10) Patent No.: US 12,130,070 B2
(45) Date of Patent: Oct. 29, 2024

(54) AIR-COOLED REFRIGERATOR AND AIR DUCT SHIELDING DEVICE THEREOF

(71) Applicants: QINGDAO HAIER REFRIGERATOR CO., LTD., Qingdao (CN); HAIER SMART HOME CO., LTD., Qingdao (CN)

(72) Inventors: Yancheng Zhao, Qingdao (CN); Huan Zhang, Qingdao (CN); Falin Yang, Qingdao (CN); Baolong Mao, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 240 days.

(21) Appl. No.: 17/921,626

(22) PCT Filed: Dec. 18, 2020

(86) PCT No.: PCT/CN2020/137536
§ 371 (c)(1),
(2) Date: Oct. 26, 2022

(87) PCT Pub. No.: WO2021/218191
PCT Pub. Date: Nov. 4, 2021

(65) Prior Publication Data

US 2023/0160624 A1 May 25, 2023

(30) Foreign Application Priority Data

Apr. 28, 2020 (CN) ..... 202010348051.9

(51) Int. Cl.
*F25D 17/08* (2006.01)
*F25D 17/04* (2006.01)

(52) U.S. Cl.
CPC ..... *F25D 17/08* (2013.01); *F25D 17/045* (2013.01)

(58) Field of Classification Search
CPC ..... F25D 17/045; F25D 17/06; F25D 2317/0681; F25D 2317/0683; F25D 2317/063; F04D 29/4246; F04D 29/464
See application file for complete search history.

(56) References Cited

U.S. PATENT DOCUMENTS

| | | | |
|---|---|---|---|
| 6,240,735 | B1 | 6/2001 | Kolson et al. |
| 10,619,906 | B2 | 4/2020 | Zhang et al. |
| 2017/0336127 | A1 | 11/2017 | Fei et al. |

FOREIGN PATENT DOCUMENTS

| | | | |
|---|---|---|---|
| CN | 106168426 | A | 11/2016 |
| CN | 106196837 | A | 12/2016 |

(Continued)

OTHER PUBLICATIONS

English language translation of WO2018188644 to Fei. Translated Aug. 2024 (Year: 2018).*

*Primary Examiner* — Cassey D Bauer
(74) *Attorney, Agent, or Firm* — Cheng-Ju Chiang

(57) ABSTRACT

The present invention discloses an air duct shielding device and an air-cooled refrigerator; the air duct shielding device includes: a fan base having a plurality of air outlets; a first adjusting part having a rotary disc portion and a plurality of first shielding sheets arranged at intervals, the first adjusting part being configured to controllably rotate around an axis of the rotary disc portion; and a second adjusting part provided between the first adjusting part and the fan base, the second adjusting part having a plurality of second shielding sheets arranged at intervals; wherein when the first adjusting part rotates around the axis of the rotary disc portion, the second adjusting part is driven to rotate, such that the first shielding sheet and/or the second shielding sheet completely shield(s), (Continued)

partially shield(s) or completely expose(s) each air outlet, thereby adjusting an air outlet area of each of the plural air outlets.

10 Claims, 6 Drawing Sheets

(56) References Cited

FOREIGN PATENT DOCUMENTS

| | | | | | |
|---|---|---|---|---|---|
| CN | 106196842 | A | | 12/2016 | |
| CN | 109990544 | A | | 7/2019 | |
| CN | 212378313 | U | | 1/2021 | |
| JP | H3-10149 | U | | 1/1991 | |
| JP | 2001-280800 | A | | 10/2001 | |
| JP | 2018-509584 | A | | 4/2018 | |
| JP | 2018-513338 | A | | 5/2018 | |
| JP | 2019-27430 | A | | 2/2019 | |
| KR | 10-2012-0008277 | A | | 1/2012 | |
| WO | WO-2018188644 | A1 | * | 10/2018 | ..... F25D 11/02 |

* cited by examiner

AIR-COOLED REFRIGERATOR AND AIR DUCT SHIELDING DEVICE THEREOF

CROSS REFERENCE TO RELATED APPLICATIONS

The present application is a 35 U.S.C. § 371 National Phase conversion of International (PCT) Patent Application No. PCT/CN2020/137536, filed on Dec. 18, 2020, which claims the priority of Chinese Application No. 202010348051.9 filed on Apr. 28, 2020, the disclosure of which is incorporated by reference herein. The PCT International Patent Application was filed and published in Chinese.

TECHNICAL FIELD

The present invention relates to the field of freezing and refrigerating technologies, and in particular to, an air-cooled refrigerator and an air duct shielding device thereof.

BACKGROUND

An air-cooled refrigerator may keep food fresh, prolong a storage time of the food and improve food safety, and thus is a necessary household appliance.

A freshness keeping performance of the air-cooled refrigerator largely depends on air flow circulation in a storage chamber of the air-cooled refrigerator and a temperature difference among all parts in the refrigerator. The more reasonable the air flow circulation in the refrigerator is, and the smaller the temperature difference is, the better the freshness keeping performance of the refrigerator is. A key component for determining whether the air flow circulation in the refrigerator is reasonable is an air duct, and the air duct controls an air direction and a flow of the refrigerator and directly determines refrigerating and freshness-keeping effects of the refrigerator.

FIG. 1 is a schematic overall diagram of a traditional air duct shielding device; FIG. 2 is a schematic exploded diagram of the air duct shielding device of FIG. 1.

As shown in FIGS. 1 and 2, the traditional air duct shielding device 10 includes a driving base 1, an air duct shielding disc 3, a fan bearing 4, a fan base 5 and a fan 6, which are arranged in sequence; the driving base 1 is provided with a driving unit 2 which drives the air duct shielding disc 3 to rotate in a circumferential direction, such that a shielding sheet 31 on the air duct shielding disc 3 is rotated out of an accommodating space 52 of an escaping portion 51 on the fan base 5, and an air outlet 53 on the fan base 5 is partially or completely closed; or, such that the shielding sheet 31 on the air duct shielding disc 3 is rotated into the accommodating space 52 of the escaping portion 51 on the fan base 5, and the air outlet 53 on the fan base 5 is partially or completely opened.

In the air duct shielding device 10, an area of the shielding sheet 31 of the air duct shielding disc 3 is consistent with an area of the air outlet 53 of the fan base 5, and a ratio of an area of the air outlet 53 to a lateral area of the air duct shielding device 10 is unable to be higher than 50%, which limits an air supply capacity of the fan 6.

SUMMARY

An object of the present invention is to provide a new air duct shielding device, which solves a problem that an air supply capacity of a fan is limited due to a small area proportion of an air outlet in a traditional air duct shielding device, and achieves effects of increasing an area of the air outlet, increasing an air supply quantity and improving a refrigerating capacity of a refrigerator.

In order to achieve one of the above-mentioned objects, an embodiment of the present invention provides an air duct shielding device suitable for an air-cooled refrigerator, the air duct shielding device including: a fan base having a plurality of air outlets; a first adjusting part having a rotary disc portion and a plurality of first shielding sheets arranged at intervals, the first adjusting part being configured to controllably rotate around an axis of the rotary disc portion; and a second adjusting part provided between the first adjusting part and the fan base, the second adjusting part having a plurality of second shielding sheets arranged at intervals; wherein when the first adjusting part rotates around the axis of the rotary disc portion, the second adjusting part is driven to rotate, such that the first shielding sheet and/or the second shielding sheet completely shield(s), partially shield(s) or completely expose(s) each air outlet, thereby adjusting an air outlet area of each of the plural air outlets.

As an optional technical solution, the fan base includes an escaping portion, the escaping portion has a receiving cavity, and when each air outlet is completely exposed, each first shielding sheet and each second shielding sheet are overlapped with each other and received in the receiving cavity.

As an optional technical solution, the escaping portion has a U-shaped bent structure protruding from an outer edge of a circular base plate of the fan base in a direction apart from the second adjusting part.

As an optional technical solution, a limiting groove is provided in the outer edge of the circular base plate of the fan base, and the limiting groove is configured as an inwards concave arc-shaped groove formed in the outer edge of the circular base plate.

As an optional technical solution, the limiting groove is located between two adjacent escaping portions.

As an optional technical solution, the second adjusting part includes a second annular disc, the second annular disc includes a third side surface and a fourth side surface which are opposite to each other, the third side surface is adjacent to the fan base, the third side surface is provided with a limiting block, and the limiting groove is fitted with the limiting block to limit a rotation angle of the second adjusting part.

As an optional technical solution, the first adjusting part includes a first annular disc, the first annular disc includes a first side surface and a second side surface which are opposite to each other, the first side surface is adjacent to the second adjusting part, and a sliding groove is provided in the first side surface; the third side surface is also provided with a sliding block; the sliding block is inserted into the sliding groove, and the sliding groove may slide along the sliding block and push the sliding block, such that the second adjusting part rotates by a certain angle, and then, the plural second shielding sheets shield the plural air outlets or expose the plural air outlets.

As an optional technical solution, the rotary disc portion is provided on the second side surface, and the rotary disc portion is a gear structure.

As an optional technical solution, the air duct shielding device further includes a driving base and a driving unit, the driving unit is provided on one side of the driving base, the driving unit is connected with a driving gear, the driving gear meshes with the rotary disc portion, and the driving gear drives the gear structure, such that the first adjusting part rotates by a certain angle, and then, the plurality of first shielding sheets shield the plurality of air outlets or expose the plurality of air outlets.

The present invention further provides an air-cooled refrigerator, in which the air duct shielding device as mentioned above is mounted.

Compared with a prior art, the present invention has the following beneficial effects.

Two or more shielding sheets move relatively to be overlapped or extended, so as to completely expose, partially shield or completely shield the air outlet, such that the proportion of the area of the air outlet on the fan base to a lateral area of the fan base is increased, and an area of the escaping portion (air duct blind region) of the fan base is reduced, thus effectively improving the air supply capacity of the fan, and improving the refrigerating capacity of the air-cooled refrigerator.

In addition, the first adjusting part and the second adjusting part are provided with the sliding groove and the sliding block which interact with each other, thus ensuring that the first shielding sheet and the second shielding sheet may relatively move to present positions; the limiting block of the second adjusting part and the limiting groove of the fan base interact with each other, thus avoiding that the second shielding sheet of the second adjusting part rotates excessively due to inertia after reaching the present position.

Thirdly, a number of rotations of a driving motor is controlled by a program, and then, the movement positions of the first adjusting part and the second adjusting part are controlled, so as to change a size of the air outlet and achieve a variable air supply function.

DETAILED DESCRIPTION

Hereinafter, the present invention will be described in detail in conjunction with specific embodiments shown in the accompanying drawings. However, these embodiments have no limitations on the present invention, and any transformations of structure, method, or function made by persons skilled in the art according to these embodiments fall within the protection scope of the present invention.

Figure 1:
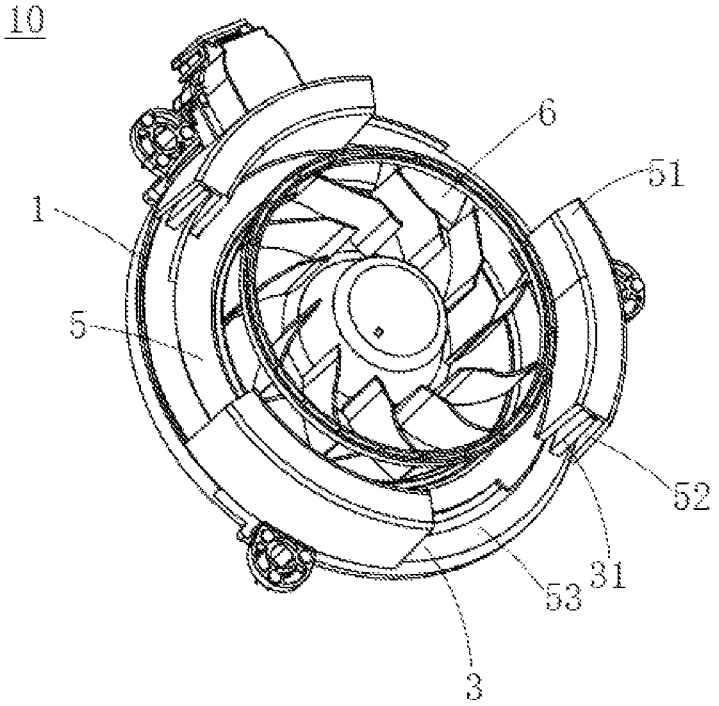
FIG. 1 (Prior Art)
FIG. 1 is a schematic overall diagram of a traditional air duct shielding device.
Figure 2:
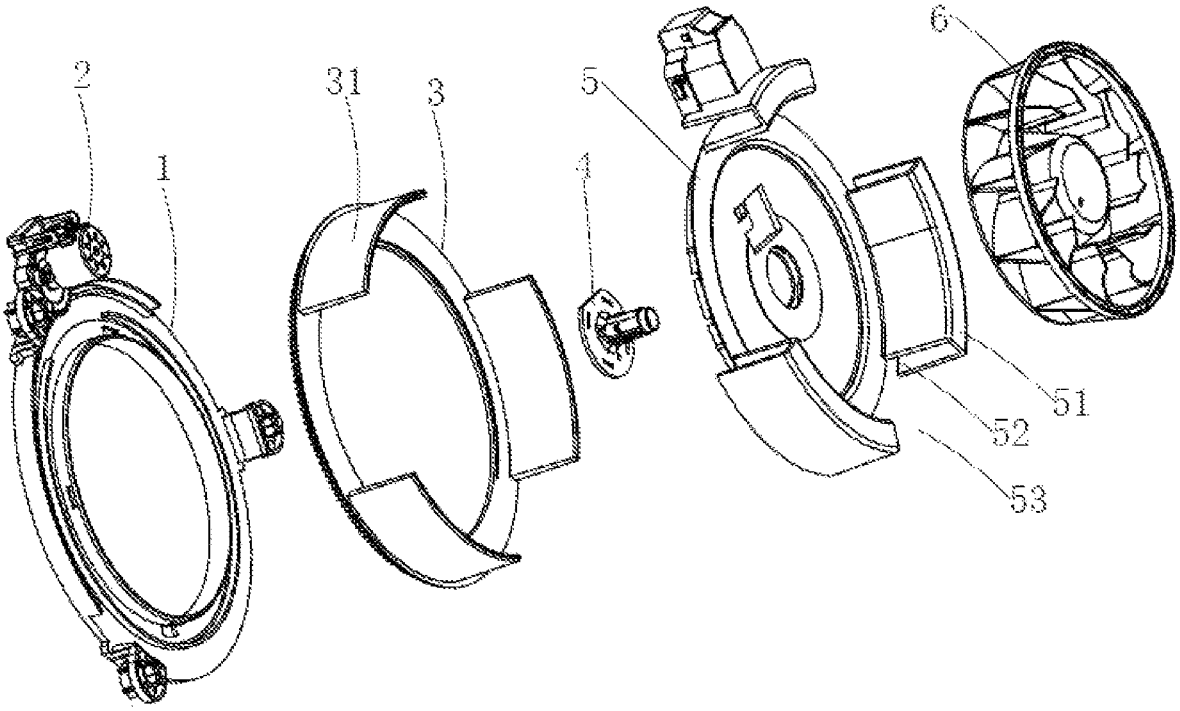
FIG. 2 (Prior Art)
FIG. 2 is a schematic exploded diagram of the air duct shielding device of FIG. 1.
Figure 3:
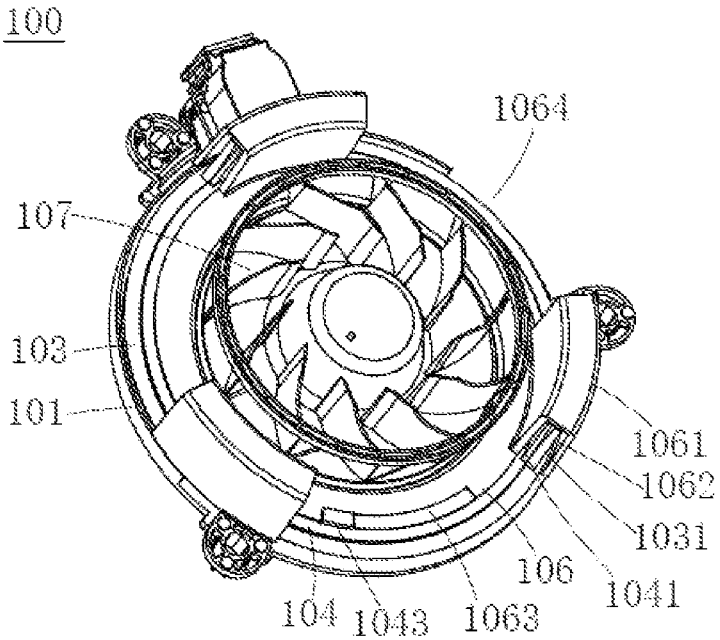
FIG. 3 is a schematic diagram in which an air outlet of an air duct shielding device according to the present invention is opened completely.
Figure 4:
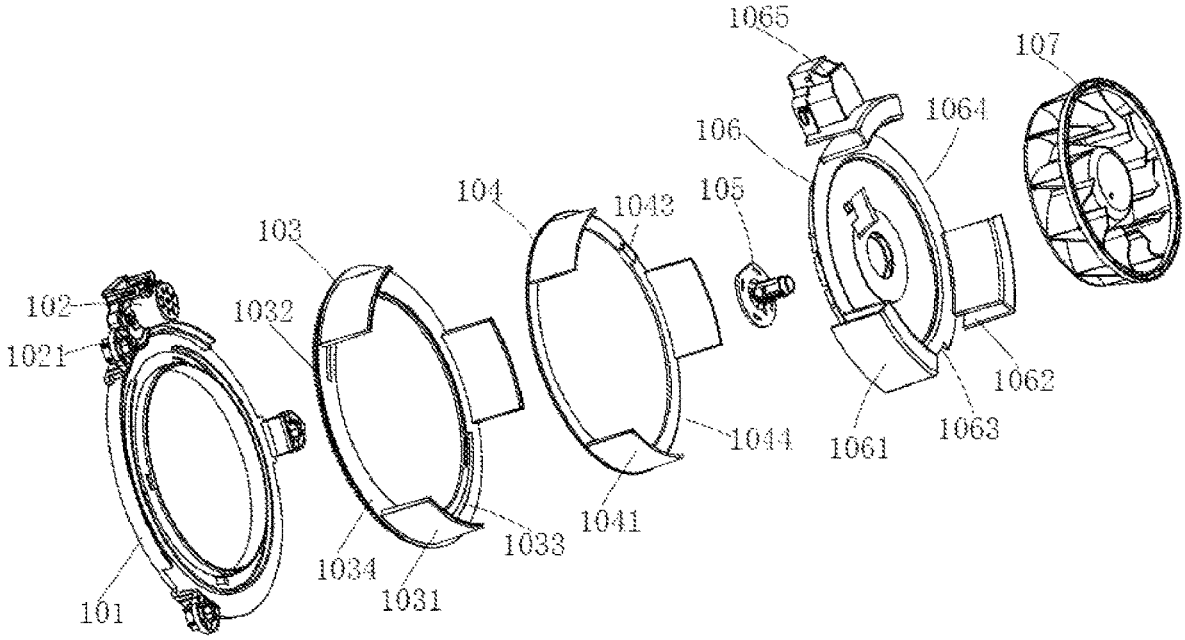
FIG. 4 is a schematic exploded diagram of the air duct shielding device of FIG. 3.

FIG. 3 is a schematic diagram in which an air outlet of an air duct shielding device according to the present invention is opened completely; FIG. 4 is a schematic exploded diagram of the air duct shielding device of FIG. 3.

As shown in FIGS. 3 and 4, the air duct shielding device 100 includes a driving base 101, a first adjusting part 103, a second adjusting part 104, a fan base 106, and a fan 107, which are assembled in sequence; a driving unit 102 is provided on the driving base 101; the fan 107 is mounted in the fan base 106, the fan base 106 and the fan 107 are connected by a bearing 105, the bearing 105 is located in a center of the fan base 106, and the fan blades of the fan 107 rotate around the bearing 105.

Figure 7:
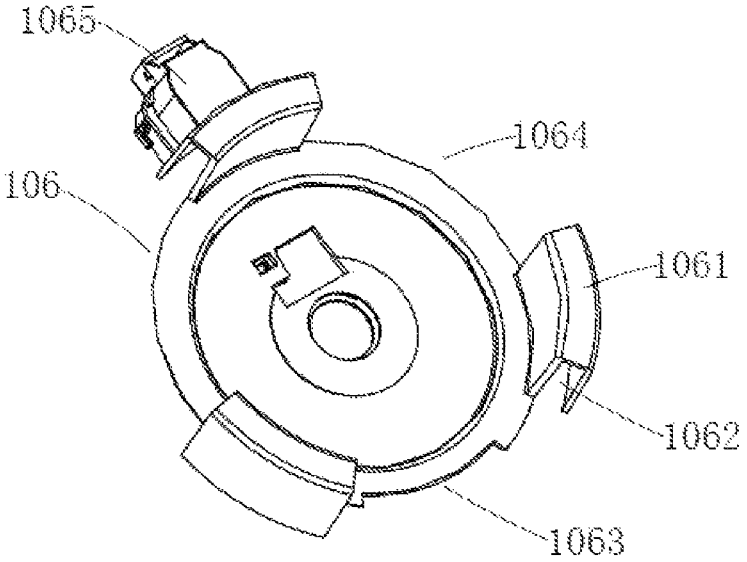
FIG. 7 is a schematic diagram of a fan base of FIG. 3.

FIG. 7 is a schematic diagram of a fan base of FIG. 3.

As shown in FIGS. 4 and 7, a circular base plate of the fan base 106 is provided with a plurality of escaping portions 1061 arranged at intervals, each escaping portion 1061 has a receiving cavity 1062, and an air outlet 1064 of the fan base 106 is defined at a gap between any adjacent escaping portions 1061.

In the present embodiment, the escaping portion 1061 has a U-shaped bent structure protruding upwards from an edge of the circular base plate of the fan base 106 (protruding in a direction apart from the second adjusting part), and an interior of the U-shaped bent structure corresponds to the receiving cavity 1062.

A limiting groove 1063 is provided in an outer edge of the circular base plate of the fan base 106, and the limiting groove 1063 is configured as, for example, an arc-shaped groove formed after the outer edge of the circular base plate is recessed. The limiting groove 1063 is located between any two adjacent escaping portions 1061. In a preferred embodiment, the limiting groove 1063 may be located in a middle of a portion between two adjacent escaping portions 1061.

In addition, the fan base 106 is further provided with an accommodating portion 1065, and the accommodating portion 1065 is configured to accommodate the driving unit 102 provided at an edge of the driving base 101.

Figure 8A:
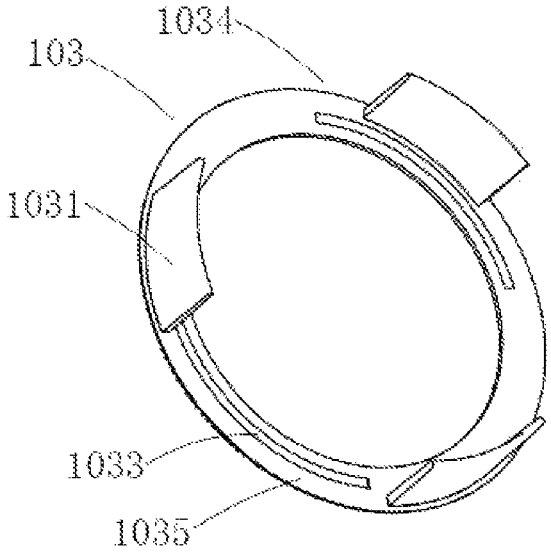
FIGS. 8A and 8B are schematic diagrams of a first adjusting part of FIG. 3 from different perspectives.
Figure 8B:
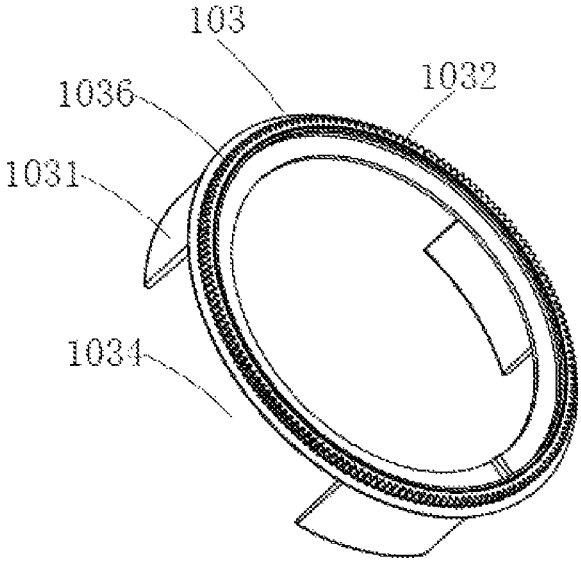

FIGS. 8A and 8B are schematic diagrams of the first adjusting part of FIG. 3 from different perspectives.

As shown in FIGS. 4, 8A and 8B, the first adjusting part 103 has a rotary disc portion 1032 and a plurality of first shielding sheets 1031 arranged at intervals, and the first adjusting part 103 is configured to controllably rotate around an axis of the rotary disc portion 1032. The plural first shielding sheets 1031 arranged at intervals and the rotary disc portion 1032 are located on two opposite sides of the first adjusting part 103 respectively.

Specifically, the first adjusting part 103 includes a first annular disc and the plurality of first shielding sheets 1031 arranged at intervals and protruding from an outer edge of the first annular disc, and a first gap 1034 is formed between any adjacent first shielding sheets 1031. When the air outlet 1064 of the air duct shielding device 100 is fully opened, the first gap 1034 coincides with the air outlet 1064. The first shielding sheet 1031 is configured as an arc-shaped sheet extending along an arc of the first annular disc. The first shielding sheet 1031 extends towards the second adjusting part 104.

The first annular disc includes a first side surface 1035 and a second side surfaces 1036 which are opposite to each other, the first side surface 1035 is adjacent to the second adjusting part 104, and the second side surface 1036 is adjacent to the driving base 101; the second side surface 1036 has the rotary disc portion 1032, and the rotary disc portion 1032 has a gear structure formed on the second side surface 1036, for example. When the first adjusting part 103 and the driving base 101 are assembled, the gear structure meshes with a driving gear 1021 on the driving base 101, the driving gear 1021 is connected with the driving unit 102, and for example, the driving unit 102 is configured as a driving motor 102.

As shown in FIG. 8A, the first side surface 1035 is further provided with a sliding groove 1033, and the sliding groove 1033 is fitted with a sliding block 1042 (shown in FIG. 9B) of the second adjusting part 104. When the driving gear 1021 rotates, the rotary disc portion 1032 meshing with the driving gear 1021 rotates, the rotary disc portion 1032 drives the first adjusting part 103 to rotate, and then, an end portion of the sliding groove 1033 on the first adjusting part 103 pushes the sliding block 1042 embedded in the sliding groove 1033, such that the second adjusting part 104 rotates with the rotation of the first adjusting part 103.

Furthermore, an axis of the rotary disc portion 1032 coincides with a circle center of the first annular disc.

Figure 9A:
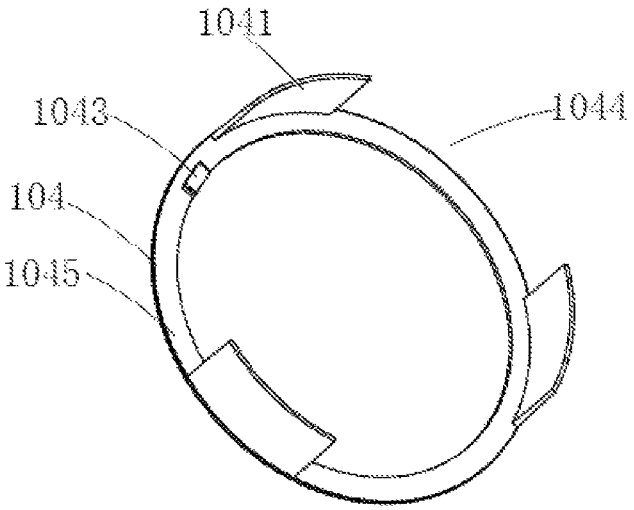
FIGS. 9A and 9B are schematic diagrams of a second adjusting part of FIG. 3 from different perspectives.
Figure 9B:
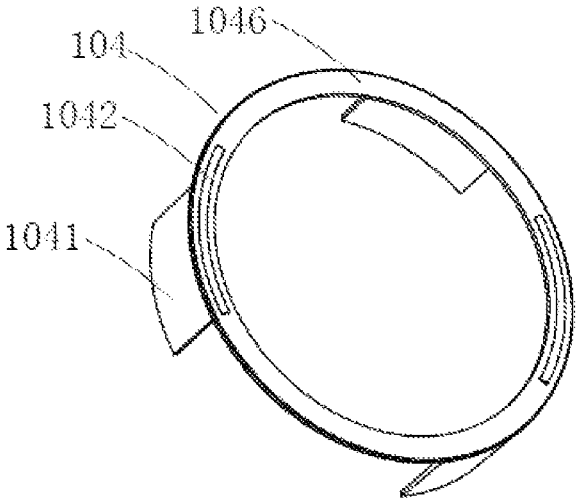

FIGS. 9A and 9B are schematic diagrams of the second adjusting part of FIG. 3 from different perspectives.

As shown in FIGS. 4, 9A and 9B, the second adjusting part 104 is interposed between the first adjusting part 103 and the fan base 106.

Specifically, the second adjusting part 104 includes a second annular disc and a plurality of second shielding sheets 1041 arranged at intervals and protruding from an outer edge of the second annular disc, and a second gap 1044 is formed between any adjacent second shielding sheets 1041. When the air outlet 1064 of the air duct shielding device 100 is fully opened, the second gap 1044 coincides with the air outlet 1064 and the first gap 1034. The second shielding sheet 1041 is configured as an arc-shaped sheet extending along an arc of the second annular disc. The second shielding sheet 1041 extends towards the fan base 106.

As may be seen from FIG. 3, when the air outlet 1064 of the air duct shielding device 100 is fully opened, each second shielding sheet 1041 and each first shielding sheet 1031 are located in the receiving cavity 1062 of the escaping portion 1061, and the first shielding sheet 1031 and the second shielding sheet 1041 in each receiving cavity 1062 are overlapped completely. Preferably, the second shielding sheet 1041 is located inside the first shielding sheet 1031; that is, the second shielding sheet 1041 is closer to the circle center of the fan base 106.

In other embodiments of the present invention, the first shielding sheet and the second shielding sheet in each receiving cavity may also be partially overlapped, but an end portion of the first shielding sheet and an end portion of the second shielding sheet are required not to extend out of openings for the shielding sheets to rotate in or out in both sides of the escaping portion.

The second annular disc includes a third side surface 1045 and a fourth side surface 1046 which are opposite to each other, the third side surface 1045 is adjacent to the fan base 106, and the fourth side surface 1046 is adjacent to the first side surface 1035 of the first adjusting part 103. The third side surface 1045 includes a limiting block 1043; the sliding block 1042 is provided on the fourth side surface 1046; the limiting block 1043 is fitted with the limiting groove 1063 in the fan base 106; the sliding block 1042 is fitted with the sliding groove 1033 in the first adjusting part 103.

In a preferred embodiment, the sliding block 1042 is inserted into the sliding groove 1033, and a length of the sliding groove 1033 is greater than a length of the sliding block 1042. After the sliding groove 1033 slides by a certain distance relative to the sliding block 1042, a groove wall at one end of the sliding groove 1033 may contact and push the sliding block 1042, such that the sliding block 1042 rotates with the sliding groove 1033, and each first shielding sheet 1031 of the first adjusting part 103 and each second shielding sheet 1041 of the second adjusting part 104 may sequentially extend from the opening in one side of the receiving cavity 1062 of the escaping portion 1061 of the fan base 106, so as to completely or partially shield the plurality of air outlets 1064 in the fan base 106.

Figure 5:
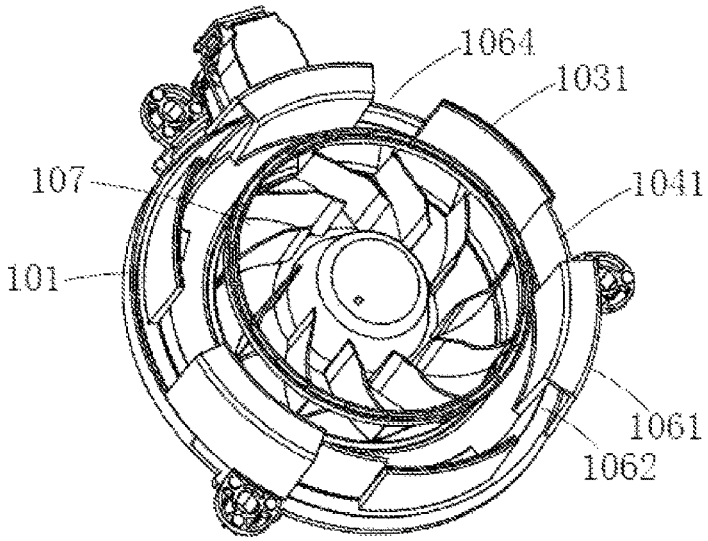
FIG. 5 is a schematic diagram in which the air outlet of the air duct shielding device of FIG. 3 is closed partially.
Figure 6:
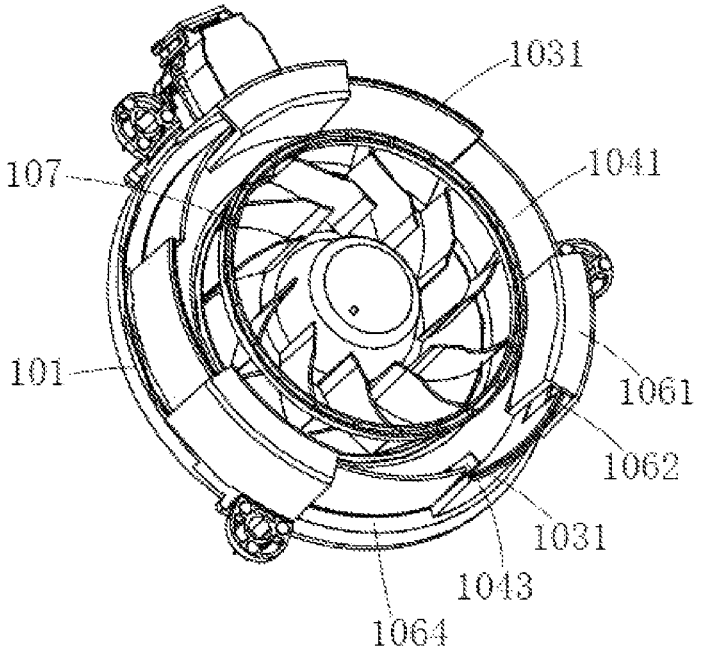
FIG. 6 is a schematic diagram in which the air outlet of the air duct shielding device of FIG. 3 is closed completely.

FIG. 5 is a schematic diagram in which the air outlet of the air duct shielding device of FIG. 3 is closed partially; FIG. 6 is a schematic diagram in which the air outlet of the air duct shielding device of FIG. 3 is closed completely.

As shown in FIGS. 3, 4, 5 and 6, the driving gear 1021 rotates to drive the rotary disc portion 1032 on the second side surface 1036 of the first adjusting part 103 to rotate, the sliding groove 1033 on the first side surface 1035 of the first adjusting part 103 rotates along the sliding block 1042 on the fourth side surface 1046 of the second adjusting part 104, and at this point, each first shielding sheet 1031 extends from the corresponding receiving cavity 1062 to shield part of the air outlet 1064.

When the first adjusting part 103 rotates by an angle, one end of the sliding groove 1033 contacts and pushes the sliding block 1042; when the first adjusting part 103 is driven to rotate continuously, the second adjusting part 104 rotates with the rotation of the first adjusting part 103, and each second shielding sheet 1041 on the second adjusting part 104 extends from the receiving cavity 1062 of each escaping portion 1061 of the fan base 106, so as to partially or completely shield each air outlet 1064 on the fan base 106.

As shown in FIG. 6, when the first shielding sheet 1031 and the second shielding sheet 1041 cooperate to completely shield the air outlet 1064 on the fan base 106, the limiting block 1043 on the third side surface 1045 of the second adjusting part 104 is stopped by the limiting groove 1063 on the fan base 106, so as to effectively avoid that the second adjusting part 104 rotates excessively due to inertia, resulting in air leakage caused by an incomplete shielding phenomenon of the air outlet 1064.

As shown in FIG. 6, when the air outlet 1064 is completely shielded, a rear end of the first shielding sheet 1031 is overlapped with a rear end of the second shielding sheet 1041, so as to prevent the air leakage caused by the incomplete shielding phenomenon of the air outlet 1064. In the present invention, an end of the first shielding sheet 1031 first extending out of the receiving cavity 1062 when the first adjusting part 103 rotates serves as a front end, and a later extending end serves as a rear end; an end of the second shielding sheet 1041 first extending out of the receiving cavity 1062 when the second adjusting part 104 rotates serves as a front end, and a later extending end serves as a rear end; but the present invention is not limited thereto.

As shown in FIG. 3, when the air outlet 1064 is required to be opened, the driving unit 102 rotates the driving gear 1021 in a reverse direction, such that the first adjusting part 103 rotates in a reverse direction, the sliding groove 1033 slides in a reverse direction along the sliding block 1042, the first shielding sheet 1031 slides towards the outside of the second shielding sheet 1041, and the air outlet 1046 is opened partially. When a groove wall at an opposite end of the sliding groove 1033 contacts and pushes the sliding groove 1042, the first adjusting part 103 continuously rotates in the reverse direction, and then, the second adjusting part 104 rotates in the reverse direction with the first adjusting part 103, and the first shielding sheet 1031 and the second shielding sheet 1041 move together towards the receiving cavity 1062 of the escaping portion 1061 of the fan base 106.

When the first shielding sheet 1031 and the second shielding sheet 1041 are overlapped with each other and stopped in the receiving cavity 1062, the air outlet 1046 is opened completely.

Similarly, the limiting block 1043 on the third side surface 1045 of the second adjusting part 104 abuts against the other end of the limiting groove 1063 on the fan base 106, so as to avoid that the second adjusting part 104 rotates excessively due to inertia, and the second shielding sheet 1041 rotates out of the opening on the other side of the receiving cavity 1062 to shield the air outlet, thereby affecting an air supply quantity.

In other words, the limiting block 1043 slides in the limiting groove 1063 and is stopped by the limiting groove 1063, which may mean that the limiting groove 1063 is configured to limit a rotation angle of the second adjusting part 104.

As shown in FIG. 5, in the air duct shielding device 100, the driving unit 102 (for example, a driving motor) on the driving base 101 may also be controlled to perform a certain number of rotations by a set program of a computer control board in the air-cooled refrigerator, and the driving gear 1021 drives the rotary disc portion 1032, such that the first adjusting part 103 rotates to a present position, and the first shielding sheet 1031 extends out of the receiving cavity 1062; meanwhile, the first adjusting part 103 acts on the sliding block 1042 of the second adjusting part 104 through the sliding groove 1033, so as to drive the second shielding sheet of the second adjusting part 104 to rotate to a present position, such that the air outlet 1064 is opened partially to achieve a variable air supply function of the fan 107.

In the present invention, in the air duct shielding device 100, the first shielding sheet 1031 and the second shielding sheet 1041 on the first adjusting part 103 and the second adjusting part 104 cooperate to completely open, partially shield or completely shield the air outlet 1064 on the fan base 106.

Compared with a traditional structure that a single shielding sheet is provided at the air outlet, in the present invention, the structure that two shielding sheets (the first shielding sheet 1031 and the second shielding sheet 1041) may be overlapped and extended is adopted, such that the proportion of the area of the plurality of air outlets 1064 to the lateral area of the fan base 106 is increased to 66.7%, and the area of the escaping portion [106] 1061 (air duct blind region) of the fan base is reduced, thus effectively improving an air supply capacity of the fan, and improving a refrigerating capacity of the air-cooled refrigerator.

In addition, after the first shielding sheet 1031 and the second shielding sheet 1041 are extended, the air outlet is shielded, and the fan 107 stops air supply; after overlapped, the first shielding sheet 1031 and the second shielding sheet 1041 are received in the escaping portion 1061 (air duct blind region) of the fan base 106, and the fan 107 starts to supply air; under a condition that a volume and a rotating speed of the fan are not changed, the air supply quantity is increased, and a refrigeration effect of the air-cooled refrigerator is improved.

Certainly, in other embodiments of the present invention, by continuously adding a plurality of adjusting parts, three or more shielding sheets move relatively to completely shield, partially shield or completely expose the air outlet on the fan base, so as to further reduce the area of the escaping portion (air duct blind region) on the fan base, further increase the area proportion of the air outlet, increase the air supply quantity of the fan, and improve the refrigeration effect of the air-cooled refrigerator.

The present invention further provides an air-cooled refrigerator, in which the above-mentioned air duct shielding device 100 is mounted.

In summary, the air duct shielding device and the air-cooled refrigerator having the same according to the present invention have the following beneficial effects.

Two or more shielding sheets move relatively to be overlapped or extended, so as to completely expose, partially shield or completely shield the air outlet, such that the proportion of the area of the air outlet on the fan base to a lateral area of the fan base is increased, and an area of the escaping portion (air duct blind region) of the fan base is reduced, thus effectively improving the air supply capacity of the fan, and improving the refrigerating capacity of the air-cooled refrigerator.

In addition, the first adjusting part and the second adjusting part are provided with the sliding groove and the sliding block which interact with each other, thus ensuring that the first shielding sheet and the second shielding sheet may relatively move to present positions; the limiting block of the second adjusting part and the limiting groove of the fan base interact with each other, thus avoiding that the second shielding sheet of the second adjusting part rotates excessively due to inertia after reaching the present position.

Thirdly, a number of rotations of a driving motor is controlled by a program, and then, the movement positions of the first adjusting part and the second adjusting part are controlled, so as to change a size of the air outlet and achieve a variable air supply function.

It should be understood that although the present specification is described based on embodiments, not every embodiment contains only one independent technical solution. Such a narration way of the present specification is only for the sake of clarity. Those skilled in the art should take the present specification as an entirety. The technical solutions in the respective embodiments may be combined properly to form other embodiments which may be understood by those skilled in the art.

A series of the detailed descriptions set forth above is merely specific description of feasible embodiments of the present invention, and is not intended to limit the protection scope of the present invention. Equivalent embodiments or modifications made within the spirit of the present invention shall fall within the protection scope of the present invention.

What is claimed is:

1. An air duct shielding device suitable for an air-cooled refrigerator, the air duct shielding device comprising:

a fan base having a plurality of air outlets;

a first adjusting part having a rotary disc portion and a plurality of first shielding sheets arranged at intervals, the first adjusting part being configured to controllably rotate around an axis of the rotary disc portion; and a second adjusting part provided between the first adjusting part and the fan base, the second adjusting part having a plurality of second shielding sheets arranged at intervals;

wherein when the first adjusting part rotates around the axis of the rotary disc portion, the second adjusting part is driven to rotate, such that the first shielding sheet and/or the second shielding sheet completely shield(s), partially shield(s) or completely expose(s) each air outlet, thereby adjusting an air outlet area of each of the plural air outlets.

2. The air duct shielding device according to claim 1, wherein the fan base comprises an escaping portion, the escaping portion has a receiving cavity, and when each air outlet is completely exposed, each first shielding sheet and each second shielding sheet are overlapped with each other and received in the receiving cavity.

3. The air duct shielding device according to claim 2, wherein the escaping portion has a U-shaped bent structure protruding from an outer edge of a circular base plate of the fan base in a direction apart from the second adjusting part.

4. The air duct shielding device according to claim 2, wherein a limiting groove is provided in the outer edge of the circular base plate of the fan base, and the limiting groove is configured as an inwards concave arc-shaped groove formed in the outer edge of the circular base plate.

5. The air duct shielding device according to claim 4, wherein the limiting groove is located between two adjacent escaping portions.

6. The air duct shielding device according to claim 4, wherein the second adjusting part comprises a second annular disc, the second annular disc comprises a third side surface and a fourth side surface which are opposite to each other, the third side surface is adjacent to the fan base, the third side surface is provided with a limiting block, and the limiting groove is fitted with the limiting block to limit a rotation angle of the second adjusting part.

7. The air duct shielding device according to claim 6, wherein the first adjusting part comprises a first annular disc, the first annular disc comprises a first side surface and a second side surface which are opposite to each other, the first side surface is adjacent to the second adjusting part, and a sliding groove is provided in the first side surface; the third side surface is also provided with a sliding block; the sliding block is inserted into the sliding groove, and the sliding groove may slide along the sliding block and push the sliding block, such that the second adjusting part rotates by a certain angle, and then, the plural second shielding sheets shield the plural air outlets or expose the plural air outlets.

8. The air duct shielding device according to claim 7, wherein the rotary disc portion is provided on the second side surface, and the rotary disc portion is of a gear structure.

9. The air duct shielding device according to claim 8, further comprising a driving base and a driving unit, wherein the driving unit is provided on one side of the driving base, the driving unit is connected with a driving gear, the driving gear meshes with the rotary disc portion, and the driving gear drives the gear structure, such that the first adjusting part rotates by a certain angle, and then, the plurality of first shielding sheets shield the plurality of air outlets or expose the plurality of air outlets.

10. An air-cooled refrigerator, in which the air duct shielding device according to claim 1 is mounted.

* * * * *